US006474279B2

(12) United States Patent
Faria

(10) Patent No.: US 6,474,279 B2
(45) Date of Patent: Nov. 5, 2002

(54) VALVE TRAIN OF AN INTERNAL COMBUSTION ENGINE COMPRISING A SWITCHABLE, ROTATIONALLY SYMMETRICAL COMPONENT

(75) Inventor: Christof Faria, Erlangen (DE)

(73) Assignee: INA-Schaeffler KG (DE)

( * ) Notice: Subject to any disclaimer, the term of this patent is extended or adjusted under 35 U.S.C. 154(b) by 0 days.

(21) Appl. No.: 10/078,993

(22) Filed: Feb. 19, 2002

(65) Prior Publication Data

US 2002/0124823 A1 Sep. 12, 2002

(30) Foreign Application Priority Data

Mar. 7, 2001 (DE) ..... 101 10 914

(51) Int. Cl.[7] ..... F01L 1/12
(52) U.S. Cl. ..... 123/90.16; 123/90.5; 123/198 F
(58) Field of Search ..... 123/90.15, 90.16, 123/90.48, 90.5, 198 F

(56) References Cited

U.S. PATENT DOCUMENTS 6,164,255 A * 12/2000 Maas et al. ..... 123/90.16
6,196,175 B1 * 3/2001 Church ..... 123/90.16
6,345,596 B1 * 2/2002 Kuhl ..... 123/90.16
6,405,699 B1 * 6/2002 Church ..... 123/90.5

* cited by examiner

*Primary Examiner*—Weilun Lo
(74) *Attorney, Agent, or Firm*—Bierman, Muserlian and Lucas

(57) ABSTRACT

In a valve train of an internal combustion engine (18) comprising a switchable, rotationally symmetrical component (1) such as a cam follower, a first body (8) acting as an anti-rotation device and a second body (12) acting as a mounting safety device project beyond the component (1). Due to the additional, second body (12) that acts as a mounting safety device, said component (1) can no longer be installed in bores for non-switchable components, for example, in the same internal combustion engine.

14 Claims, 1 Drawing Sheet

VALVE TRAIN OF AN INTERNAL COMBUSTION ENGINE COMPRISING A SWITCHABLE, ROTATIONALLY SYMMETRICAL COMPONENT

FIELD OF THE INVENTION

The invention concerns a valve train of an internal combustion engine comprising a switchable, rotationally symmetrical component such as a cam follower or a support element for a lever-type cam follower, said component comprising a housing that is mounted with an outer peripheral surface in a bore connected to the internal combustion engine, said component further comprising a cavity which encloses an inner element that is axially displaceable relative to the housing, a coupling element being provided in the housing for coupling the inner element and the housing in a relative position to each other, an anti-rotation device in form of a first body that projects radially beyond the housing being guided in a first longitudinal groove of the bore of the internal combustion engine.

BACKGROUND OF THE INVENTION

A generic valve train of the pre-cited type is disclosed in DE 199 155 31 A1. This proposes a switchable cam follower for activating a tappet push rod. The anti-rotation device of this cam follower is a body, identified at (27), that projects beyond a housing. With regard to its size, its weight and particularly with regard to its overall outer appearance, this cam follower does not differ, or differs only slightly, from non-switchable cam followers. Therefore, in a combined installation of switchable and non-switchable cam followers in bores of internal combustion engines or cylinder heads there is a danger of confusion of parts and the risk of wrong installation.

OBJECTS OF THE INVENTION

It is an object of the invention to provide a valve train of the pre-cited type in which the aforesaid drawback is eliminated.

This and other objects and advantages of the invention will become obvious from the following detailed description.

SUMMARY OF THE INVENTION

The invention achieves the above objects by the fact that a second, pin-like body acting as a mounting safety device is arranged in a through-bore of the housing, and extends radially inward and outward beyond the housing, said second body being guided with an outer section in a second longitudinal groove of the bore of the internal combustion engine, and the cavity of the housing comprises in a peripheral portion in which the second body is arranged, a material reduction such as an annular groove into which an inner section of the second body extends.

In this way, a simple mounting safety device for the switchable component is obtained. At the same time, only slight structural modifications have to be made to the component for the arrangement of the novel mounting safety device. The drawback of confusion of switchable with non-switchable components is eliminated. Due to the configuration of the internal combustion engine with the second longitudinal groove for the component, switchable components with their second body, in particular, can no longer be installed in bores for non-switchable components. To put it differently, the engine fitter also recognizes, due to the presence of the second longitudinal groove, the incorrect arrangement if non-switchable components are wrongly mounted in bores for switchable components.

Another advantage of the claimed configuration of the annular groove in the housing for an inner section of the second body, is that the total mass of the housing and, thus also, of the component can be reduced.

According to a preferred embodiment of the invention, the second body can be made, for example, of a plastic, which, if desired may be colored or provided with a color coating or at least be colorable. This elastic body can be installed in the through-bore of the housing in a simple manner, for example, by a proposed snap or clip connection. Due to the color contrast of the second body with the housing, for example, by using a striking color like yellow or red, a further, special protection from confusion during mounting is obtained.

It is further proposed to provide at least one longitudinal slot in the second body. This measure enables it to be easily pressed together during assembly and facilitates its arrangement in the through-bore.

According to a further proposition of the invention, the second body is arranged at a relatively high level in the region of an edge of the housing beyond which the inner element projects. As a result, the second longitudinal groove in the internal combustion engine requires only a small axial depth which advantageously reduces manufacturing costs. Further, the geometry of the second longitudinal groove can be chosen relatively freely because it surrounds the outer peripheral surface of the second body with clearance. This means that its shape must not necessarily be complementary to the outer peripheral surface of the second body.

Due to the proposed pin-like geometry of the second body, it is simple to make and its positioning in the through-bore of the housing does not pose any great production problems.

Although a preferred means for fixing the second body in the housing is a snap or clip connection, it is also conceivable to use other fixing measures such as screwing, pressing-in or gluing and the like. It is understood that a person skilled in the art will also think of geometrical shapes for the second body other than the pin-like shape proposed by the invention.

Advantageously, the proposed snap connection of the second body to the housing has no repercussions whatever on the housing and can be realized in a simple and economic manner.

Although the invention particularly proposes only one body as a mounting safety device and only one body as an anti-rotation device, a plurality of these may be used on a single component.

The component envisaged is particularly a roller or a mushroom tappet that follows a cam of a bottom camshaft and acts on a tappet push rod. However, the measures proposed by the invention can also be used, for example, on a cup tappet of a direct-acting type or on a support element of a lever-type cam follower.

The invention will now be described more closely with reference to the appended drawings.

DETAILED DESCRIPTION OF THE DRAWINGS

Figure 1:
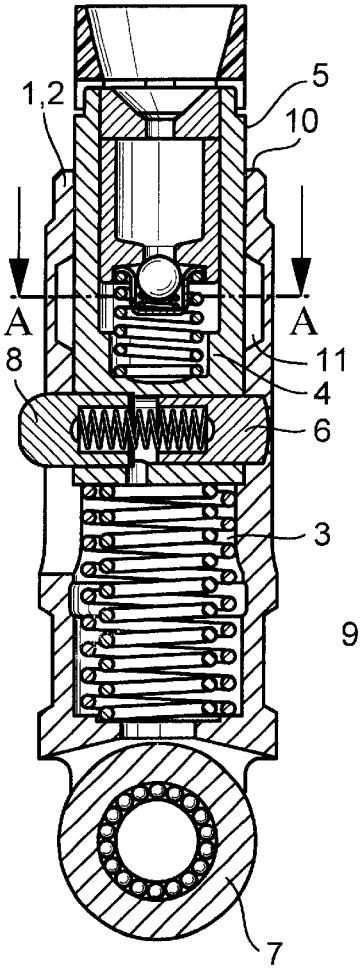
FIG. 1 is a longitudinal section through a component configured as a roller tappet.

FIG. 1 discloses a switchable, rotationally symmetrical component 1 that is configured in the present case as a roller tappet. For a more detailed description of the structure and mode of operation of such a component 1, the reader is referred to the prior art document DE 199 155 31 A1 cited above and the generic prior art mentioned therein or to the prior art references considered by the patent office for judging the patentability.

The component 1 comprises a housing 2 having a cavity 3. An inner element 4 extends with its outer peripheral surface 5 within the cavity 3 for axial displacement relative thereto. A coupling means 6, needing no specific description here, is installed in the component 1. The coupling means 6 serves to couple the inner element 4 and the housing 2 in a relative position to each other. On one end, the housing 2 comprises a roller 7 for making contact with a cam. At the other end, the inner element 4 acts on an end of a tappet push rod, not represented in the drawing.

One skilled in the art will see further in FIG. 1 that a first body 8 acting as an antirotation device protrudes radially beyond the housing 2. The body 8 is configured in the present case as a pin that is guided in a longitudinal groove 9 (see also FIG. 2) of an internal combustion engine 18. Further, the cavity 3 of the housing 2 comprises in the vicinity of its edge 10, a material reduction 11 made as an annular groove for a second body 12 that acts as a mounting safety device and is described more closely in the following.

Figure 2:
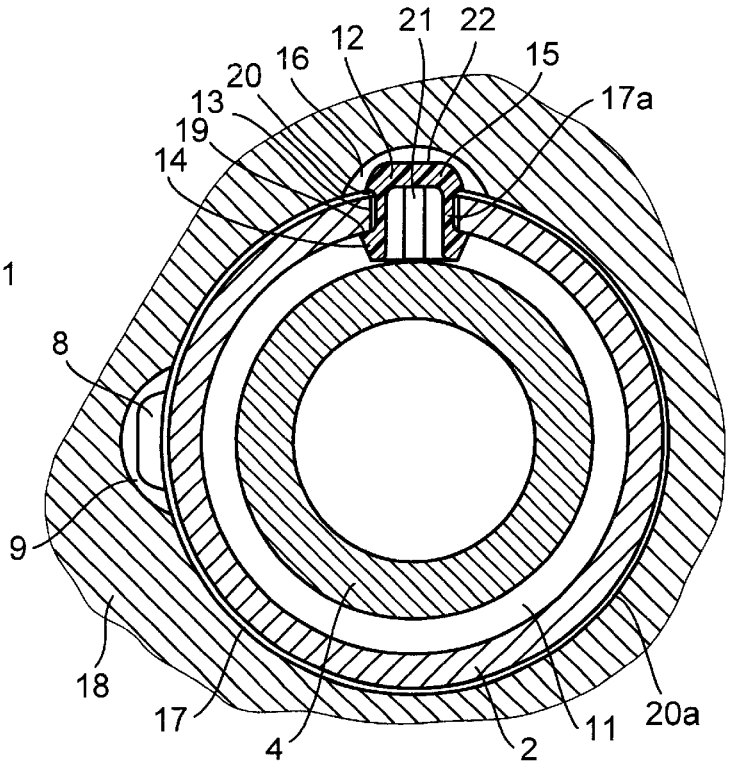
FIG. 2 is a section taken along line A—A of FIG. 1.

The second body 12 is shown in FIG. 2. It has a pin-like configuration and is disposed in a separate through-bore 13 of the housing 2. This through-bore 13 is offset at 90° in peripheral direction to the first body 8 that acts as an anti-rotation device. The second body 12 extends with its inner section 14 into the material reduction 11 of the housing 2, which material reduction 11 is arranged at a high level and is configured as an annular groove. With its outer section 15, the second body 12 extends with clearance in a second longitudinal groove 16 of a bore 17 of the internal combustion engine 18.

A central section 17*a* of the second body 12 is made as a diameter reduction and extends directly in the through-bore 13. At each end, the central section 17*a* comprises an annular end face 19, 20. Through these end faces, the inner section 14 and the outer section 15 are snapped respectively behind the cavity 3 and onto an outer peripheral surface 20*a* of the housing 2.

To facilitate the snapping of the second body 12 during its introduction into the through-bore 13 radially from the outside (assembly) despite, for example, the elastic configuration of the second body 12, this second body 12 comprises longitudinal slots 21.

As indicated in the drawing, the second body 12 can be made of a light-weight material such as plastic. This is very simple to manufacture and hardly increases the overall mass of the cam follower. An outer peripheral surface 22 of the outer section 15 is guided with clearance in the second longitudinal groove 16. It can also be seen that the outer peripheral surface 22 is not entirely complementary in shape to the second longitudinal groove 16.

Figure 3A:
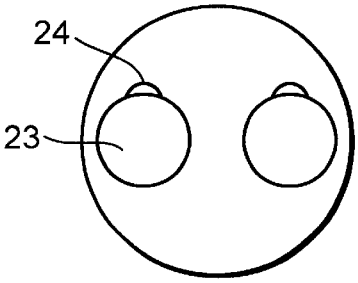
FIG. 3 is a schematic top view of bores of an internal combustion engine on the crankcase side.
Figure 3B:
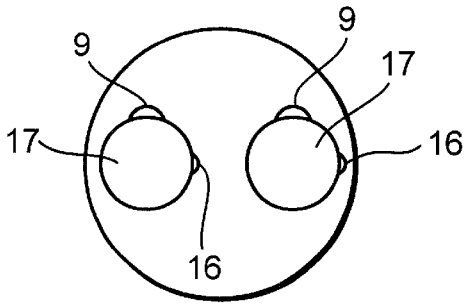

Due to the provision of the second body 12 as a mounting safety device, the aforesaid danger of confusion during a common mounting of switchable and non-switchable, rotationally symmetrical components on an internal combustion engine no longer exists. In this connection, special attention is drawn to FIGS. 3*a* and 3*b*. FIG. 3*a* shows a view of bores 23 for non-switchable components similar, for example, to the component represented in FIG. 1, longitudinal grooves 24 being provided only for an anti-rotation body. FIG. 3*b* is a view similar to that of FIG. 3*a* but with bores 17 for the component 1 and the first longitudinal groove 9 for the first body 8 as well as the second longitudinal groove 16 for the second body 12 that acts as a mounting safety device.

What is claimed is:

1. A valve train of an internal combustion engine comprising a switchable, rotationally symmetrical component, said component comprising a housing that is mounted with an outer peripheral surface in a bore connected to the internal combustion engine, said housing further comprising a cavity which encloses an inner element that is axially displaceable relative to the housing, a coupling element being provided in the housing for coupling the inner element and the housing in a relative position to each other, and anti-rotation device in form of a first body that projects radially beyond the housing being guided in a first longitudinal groove of the bore of the internal combustion engine, wherein a second, pin-like body acting as a mounting safety device is arranged in a through-bore of the housing and extends radially inward and outward beyond the housing, said second body being guided with an outer section in a second longitudinal groove of the bore of the internal combustion engine, and the cavity of the housing comprises in a peripheral portion in which the second body is arranged, a material reduction into which an inner section of the second body extends.

2. A valve train of claim 1, wherein the switchable, rotationally symmetrical component is a cam follower.

3. A valve train of claim 1, wherein the second longitudinal groove surrounds the outer section of the second body with clearance.

4. A valve train of claim 1, wherein the material reduction is configured as an annular groove.

5. A valve train of claim 1, wherein the second body is made at least substantially of an elastic material.

6. A valve train of claim 5, wherein the elastic material is a plastic.

7. A valve train of claim 1, wherein the second body is fixed on the housing by a snap connection.

8. A valve train of claim 1, wherein the second body is fixed on the housing by a connection similar to a snap connection.

9. A valve train of claim 7, wherein a central section of the second body is made as a diameter reduction and arranged in the through-bore of the housing, said central section having two ends forming annular end faces which bear respectively against an outer peripheral surface and the cavity of the housing through the snap connection.

10. A valve train of claim 1, wherein the second body has a hollow cylindrical shape and comprises at least one slot extending in a longitudinal direction thereof.

11. A valve train of claim 1, wherein the second body is pot-shaped and comprises at least one slot extending in a longitudinal direction thereof.

12. A valve train of claim 1, wherein the second body comprises at least on an outer peripheral surface of the outer section, a color coating that differs clearly from a color of the housing.

13. A valve train of claim 1, wherein the second body and the through-bore are offset in peripheral direction from the first body.

14. A valve train of claim 1, wherein the second body and the through-bore are arranged at a height level of the housing in a vicinity of an edge of the cavity of the housing, beyond which edge the inner element projects.

* * * * *